US007152437B2

(12) United States Patent
Morita

(10) Patent No.: US 7,152,437 B2
(45) Date of Patent: Dec. 26, 2006

(54) COMPOUND NEEDLE

(75) Inventor: Toshiaki Morita, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 0 days.

(21) Appl. No.: 10/538,650

(22) PCT Filed: Dec. 5, 2003

(86) PCT No.: PCT/JP03/15639

§ 371 (c)(1),
(2), (4) Date: Jun. 10, 2005

(87) PCT Pub. No.: WO2004/057081

PCT Pub. Date: Aug. 7, 2004

(65) Prior Publication Data

US 2006/0107699 A1 May 25, 2006

(30) Foreign Application Priority Data

Dec. 20, 2002 (JP) ..... 2002-369557

(51) Int. Cl.
*D04B 35/06* (2006.01)

(52) U.S. Cl. ..... 66/120

(58) Field of Classification Search ..... 66/116, 66/120, 123

See application file for complete search history.

(56) References Cited

U.S. PATENT DOCUMENTS 5,937,673 A 8/1999 Shima
6,233,977 B1 * 5/2001 Schuler et al. ..... 66/120
6,339,942 B1 1/2002 Majer et al.
6,422,045 B1 * 7/2002 Morita et al. ..... 66/120
6,510,713 B1 * 1/2003 Shima ..... 66/120
6,915,667 B1 * 7/2005 Morita et al. ..... 66/120

FOREIGN PATENT DOCUMENTS

| | | | |
|---|---|---|---|
| EP | 1302581 | A1 | 4/2003 |
| JP | 2001-32154 | A | 2/2001 |
| WO | WO 01/31102 | A1 | 5/2001 |
| WO | WO 03/018893 | A1 | 3/2003 |

* cited by examiner

*Primary Examiner*—Danny Worrell
(74) *Attorney, Agent, or Firm*—Rothwell, Figg, Ernst & Manbeck

(57) ABSTRACT

Two blades (14, 14) of a slider of a compound needle move back into blade grooves (8, 8) of a needle body (4) on the left and right side of a partition wall (9). An opening (18) is provided at the front ends of the blades (14, 14), and curved portions (19, 19) are provided on the backside of the front ends of the blades. Further, a thick section is provided at the front end of the partition wall (9), and a thin section is provided on the backside of the thick section.

When the blades move forward from the blade grooves, the blades are centered at the thick section so that even if a lateral force is applied from a knitted loop to the blades, deformation of the blades is prevented by the contact of the two blades at the curved portions. In the blade grooves, the curved portions contact the thin section of the partition wall such that the force applied between the blades and the blade grooves does not increase.

3 Claims, 3 Drawing Sheets

COMPOUND NEEDLE

CROSS REFERENCE TO RELATED APPLICATION

This application is a 35 USC §371 National Phase Entry Application from PCT/JP03/15639, filed Dec. 5, 2003, and designating the United States.

TECHNICAL FIELD

The present invention relates to a compound needle used in a knitting machine such as a flat knitting machine or a circular knitting machine. In particular, the present invention relates to a compound needle including a needle body having blade grooves, and a slider including two blades that are movable back and forth in the blade grooves.

BACKGROUND ART

Patent Publication 1 (Japanese Patent No. 2,946,323) discloses a compound needle including a needle body having blade grooves, and a slider including two blades that are movable back and forth in the blade grooves. At the front ends of the two blades of the slider, tongues are provided. By the forward movement of the slider, the tongues close a hook at the front end of the needle body. By the further forward movement of the slider, the tongues move beyond the hook for loop transferring or the like. Further, the two blades are overlapped with each other, and accommodated in longitudinal grooves provided in a slider jack. A butt of the slider jack is manipulated for moving the blades back and forth. The base end of the needle body is attached to the needle jack, and the butt of the jack is used for manipulating the needle body. Further, in order to prevent the undesirable movement of the slider by the movement of the needle body, one of the two blades has an expansion at a position in the longitudinal groove of the slider jack. The expansion contacts the side surface of the needle groove of the needle bed. By the frictional resistance, the undesirable movement of the slider is prevented.

Patent Publication 2 (WO 01/31102A1) discloses studies about the sliding resistance at the time of the forward movement of the tongues of the compound needle beyond the hook of the needle body, and expansion of the space between the blades when the blades are widened toward the left and right by the hook. Patent publication 2 proposes to provide a partition wall between the blade grooves of the needle body, and dispose the two blades on the left and right sides of the partition wall, respectively. As a result, when the tongues move forward beyond the hook, instead of widening the two blades at a large angle, the angle of widening the blades is reduced by the partition wall to reduce the size of expansion toward the left and right. Further, since there is a gap corresponding to the partition wall between the blades, the sliding resistance between the hook and the blades is small. Further, the partition wall functions to guide the two blades, and scrub away the fiber debris entered between the blades.

In the compound needle disclosed in Patent Publication 2, a gap is formed between the two blades projecting from the blade grooves. When the blades hold a knitted loop, a force in a lateral (left or right) direction may be applied to the blades from the knitted loop. For example, when the blades hold the knitted loop at any of the opposite ends of the knitting fabric or when the blades hold the knitted loop which has been subjected to racking, since the knitted loop is pulled in the lateral direction, the force is applied to the blades. As a result, the blades may be warped undesirably, and it may not be possible to hold the hook between the two blades. Further, the two blades may be deviated toward one side of the hook undesirably. These problems may cause errors in knitting.

Terminology

In the description, "front/rear (forward/backward)" means the direction in parallel to needle grooves of needle beds. The forward movement means the movement toward the trick gap between the needle beds, and the backward movement (retraction) simply means the movement away from the trick gap between the needle beds. Further, the "left/right direction" means the direction which is parallel to the longitudinal direction of the needle beds, i.e., the direction to perpendicular to the longitudinal direction (forward/backward direction) of the compound needle, and which is in parallel to the surface of the needle beds. Further, the front end means the end near the trick gap of the respective members. The base end means the end remote from the trick gap. The front side means the side near the trick gap, and the backside means the side remote from the trick gap.

SUMMARY OF THE INVENTION

Object of the Invention

An object of the present invention is to provide a compound needle in which left and right blades are centered relative to a hook by a partition wall, and it is possible to reliably hold the hook by the blades and comparatively reduce the friction of the blades in blade grooves even if a force from a knitted loop is applied (claims 1 to 3).

Constructions of the Invention

According to the present invention, a compound needle comprises a needle body having a hook and blade grooves with a partition wall. The hook is provided at a front end of the composite needle, and a slider includes a pair of blades. The blades are movable back and forth in the blade grooves. The front ends of the two blades are opened toward the left and the right, and the blades include curved portions curved inwardly on the backside of the front ends of the blades, e.g., backwardly positioned from the front ends of the blades to some extent. Further, the partition wall has the non-uniform thickness in the longitudinal direction including a relatively thick section on the front end side of the blade grooves, and a relatively thin section, or a cutout section on the backside of the thick section (Claim 1).

Preferably, the thickness of the partition wall is relatively thin on the backside (Claim 2).

Further, preferably, when the two blades move back into the blade grooves, the curved portions contact the thick section or the cutout section of the partition wall (Claim 3). Stated otherwise, when the blades move back into the blade grooves, it is preferable that the curved portions contact the thin section or the cutout section of the partition wall. At this time, the front ends of the blades may be positioned at the thick section of the partition wall or may be positioned at the cutout section of the partition wall. In the embodiment, the front ends of the blades are provided at the boundary between the thick section and the thin section. Since the two blades move almost together, in the specification, the "blades" may mean two blades except the case in which one of the blades is described particularly.

Function and Advantages of the Invention

In the present invention, when the blades move forward from the blade grooves, the blades are centered at the partition wall. Then, when a lateral force from a knitted loop is applied to the blades, the curved portions on the backside of the front ends of the blades, e.g., backwardly positioned from the front ends of the blades to some extent contact each other, and the force is received by the rigidity of the two blades. Thus, it is possible to reliably hold the hook by the opening at the front ends of the blades. When the blades move back into the blade grooves, if the thickness of the partition wall is uniform, the curved portions are expanded by the partition wall. Thus, the front ends of the blades are further expanded, and the friction of between the blades and the blade grooves or the partition wall increases. In contrast, in the present invention, the curved portions of the blades contact the thin section or the cutout section of the partition wall. Thus, by providing the curved portions of the blades, it is possible to reduce the increase in the friction between the partition wall or the blade grooves and the blades (claims 1 to 3).

EMBODIMENTS

Figure 1:
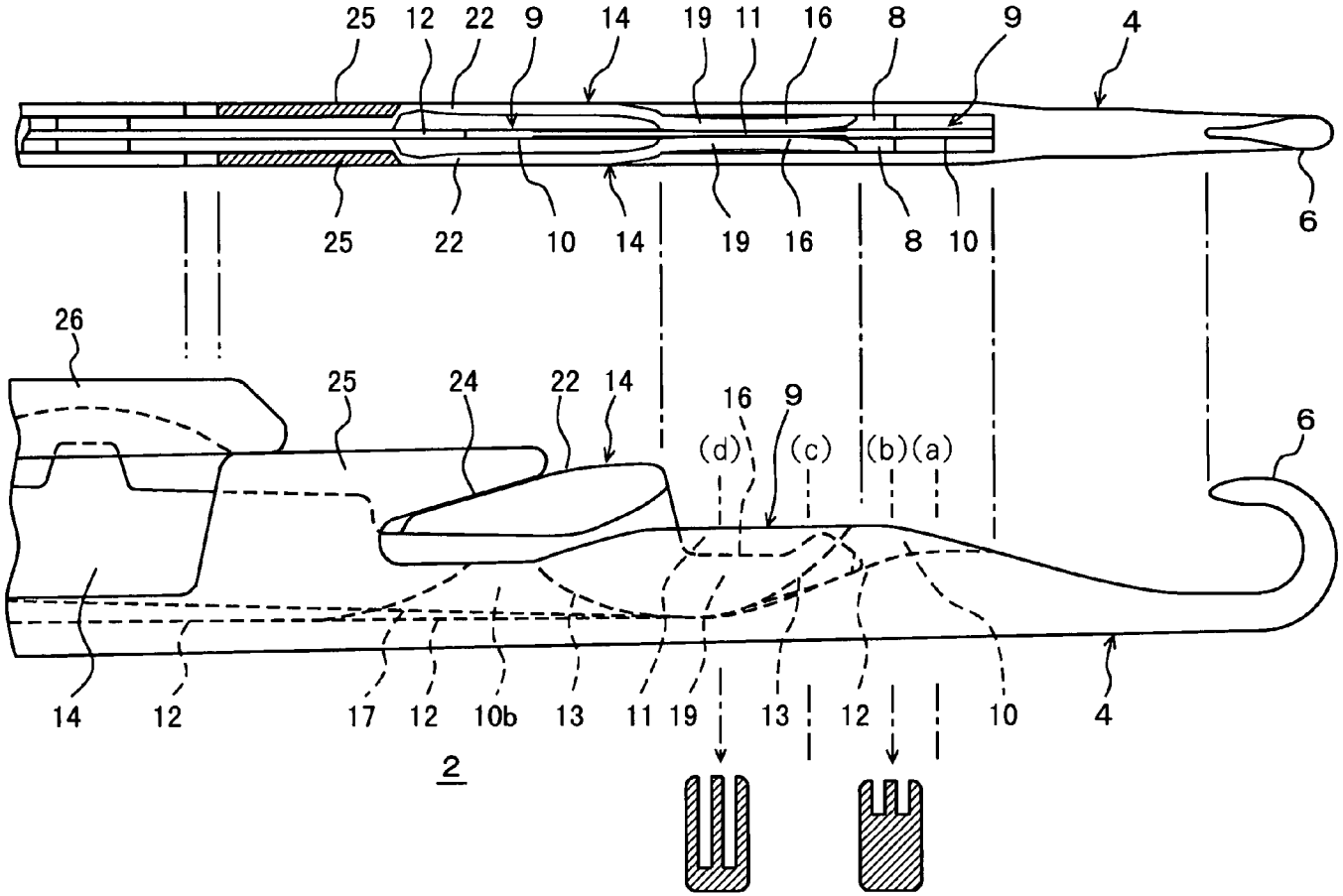
FIG. 1 includes a plan view and a side view showing main components of a compound needle according to an embodiment of the present invention, as viewed from two directions.

An embodiment will be described with reference to FIGS. 1 to 5. In the drawings, a reference numeral 2 denotes a compound needle, and a reference numeral 4 denotes a needle body. A hook 6 is provided at the front end of the needle body 4. The portion of the needle body 4 on the backside of the hook 6 may be referred to as a needle stem or a shank. Reference numerals 8, 8 denote a pair of blade grooves provided in the needle stem. The blade grooves 8 are separated into the left side and the right side by a central partition wall 9. The right side and the left side of the blade grooves 8, and the partition wall 9 are symmetrical with each other about the central line of the needle body 4 in the longitudinal direction. In a plan view of FIG. 1, guides 25 as described later are cut away.

The partition wall 9 includes a thick section 10 at the front end, and a thin section 11 in the central position of the partition wall 9, on the backside of the thick section 10, and a thick section 10*b* in the rearmost position of the partition wall 9. The thick section 10*b* may not be provided in the rearmost position. In this case, the thin section 11 may be provided also in the rearmost position. Borderlines 13 between the thick section 10 and the thin section 11, and between the thin section 11 and the thick section 10*b*, and the bottom 12 of the blade grooves 8 are shown by broken lines in a side view of FIG. 1. The borderline 13 between the thick section 10 on the front end side and the thin section 111 on the backside of the thick section 10 extends obliquely from a lower rear position to an upper front position of the blade grooves 8. Thus, at the position (c) of the cross section, the thickness of the partition wall 9 in the upper position is different from the thickness of the partition wall in the lower position of the blade grooves 8, i.e., the thickness is large on the bottom side, and the thickness is small on the upper side. Instead of providing the border between the thick section 10 and the thin section 11 obliquely like the borderline 13, the partition wall may have the uniform thickness in the upper position and the lower position of the blade grooves 8, and the thickness of the partition wall may be changed in the forward/backward direction by tapering the partition wall from the thick section 10 to the thin section 11. The thickness of the partition wall may be changed stepwise in the forward/backward direction between the thick section and the thin section.

Figure 4:
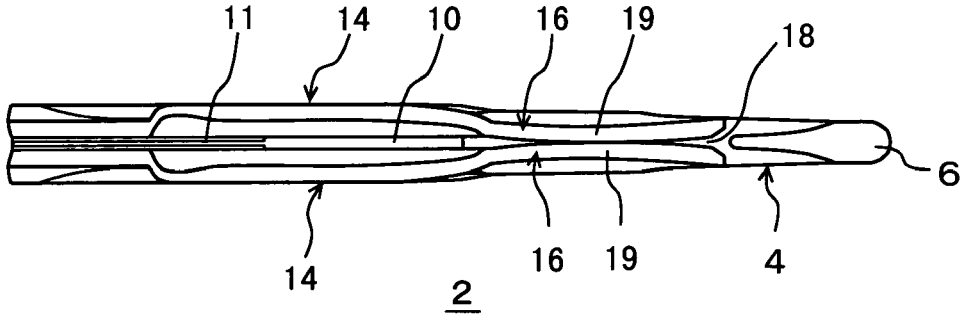
FIG. 4 is a plan view showing the main components of the compound needle in FIG. 1 in a state in which blades starts to move forward from blade grooves toward a hook.
Figure 5:
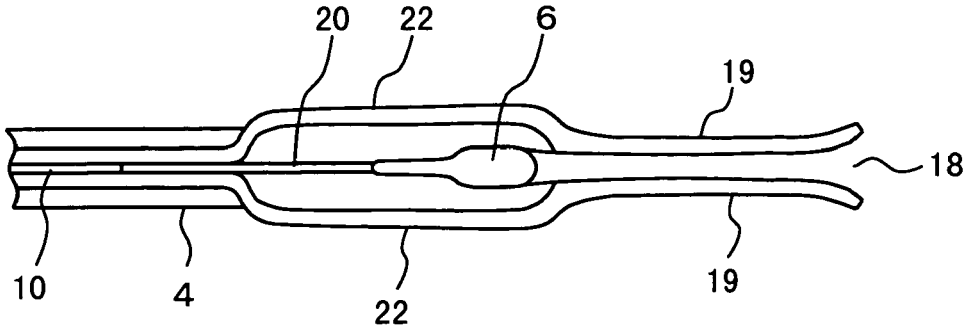
FIG. 5 is a plan view showing the compound needle in FIG. 1 in a state in which the blades further move forward beyond the hook.

Reference numerals 14, 14 denote a pair of blades. As shown in the side view of FIG. 1, the blades 14, 14 and a slider body 26 on the backside of the blades 14, 14 jointly make up a slider of the compound needle 2. FIG. 1 shows a state in which the blades 14, 14 are retracted (move back) into the blade grooves 8, 8. On the backside of the needle body 4, a body jack (not shown) is provided. The slider body 26 or the body jack is manipulated by a butt (not shown), e.g., using a cam of a carriage. At the front ends of the blades tongues 16 are provided. The bottom 17 of the blade 14 is shown by a broken line in the side view of FIG. 1. The front ends of the blades 14, 14 are slightly opened to the left and right sides to form an opening 18 as shown in FIGS. 4 and 5. On the backside of the opening 18, the blades 14, 14 have curved portions 19, 19. The curved portions 19, 19 of the blades 14, 14 are curved elastically to contact each other. However, it is not necessary that the curved portions 19 of the blades 14, 14 contact each other. For example, a small gap may be present between the blades 14, 14 at the curved portions 19 as long as the gap between the blades 14, 14 at the curved portions 19 is smaller than the gap between the blades 14, 14 at the other portions.

The blades 14, 14 contact each other at the curved portions 19, and the gap between the blades 14, 14 on the upper backside of the curved portions 19 is expanded to form expanded portions 22. Since the blades 14, 14 contact each other at the curved portions 19 or since the gap between the blades 14, 14 is the minimum at the curved portions 19, the sliding resistance between the blade 14 and the partition wall 9 or the blade grooves 8 is the maximum at the positions of the curved portions 19. As shown in the side view of FIG. 1, by a guide surface 24 provided at the lower surfaces of the guides 25, the expanded sections 22 are guided such that the blade 14 sinks in the blade grooves 8 when the blade 14 is retracted.

Figure 2:
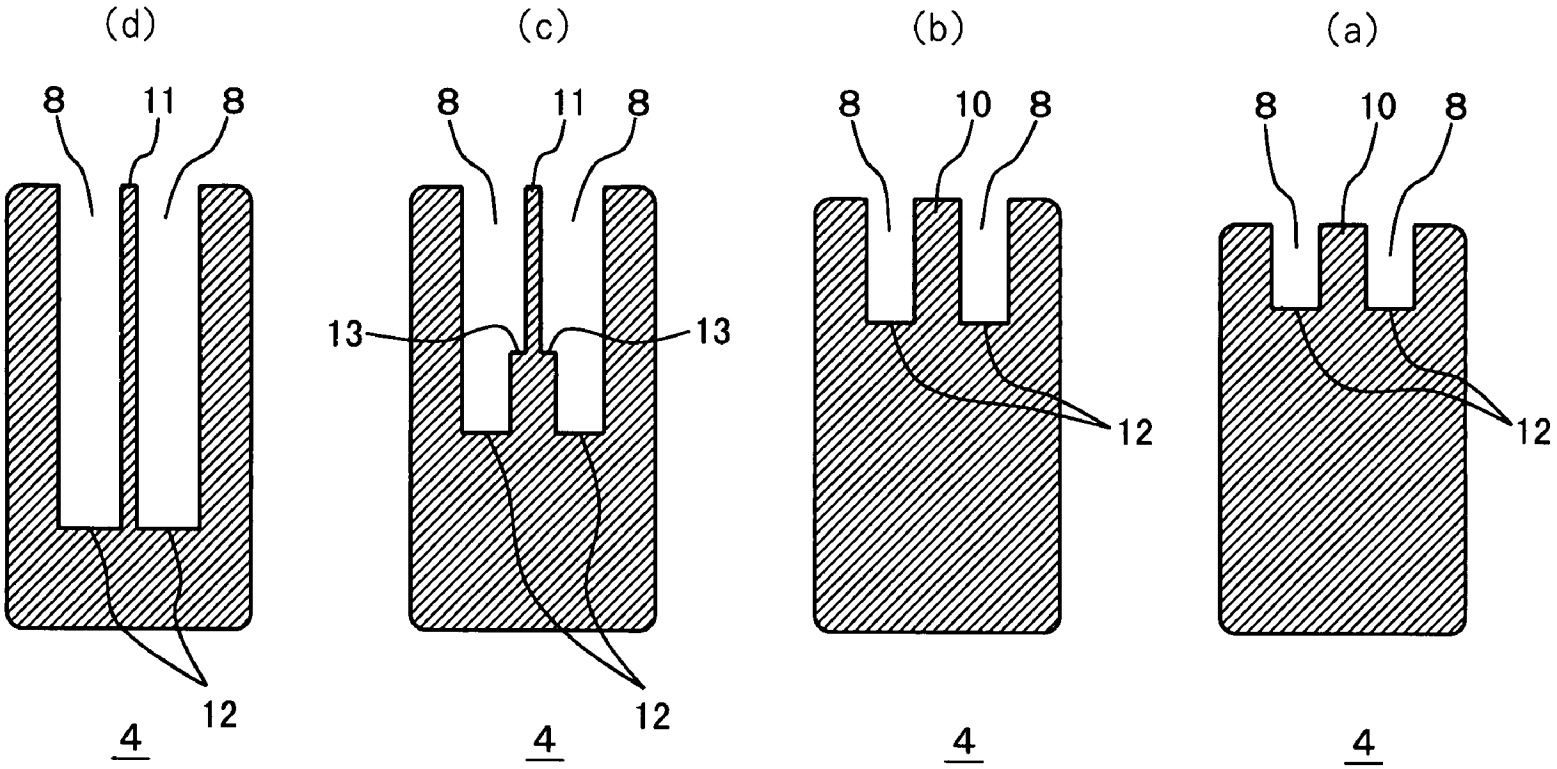
FIG. 2 includes cross sectional views showing cross sections of the compound needle in FIG. 1 at four positions (a) to (d).

FIG. 2(*a*) to FIG. 2(*d*) are enlarged views showing cross sections of the needle body 4 at the positions (a) to (d) in FIG. 1. The depth of the blade grooves 8 gets larger from the thick section 10 at the front end of the partition wall to the thin section 11. At the positions (a), (b), the partition wall is thick. At the position (c), the upper portion of the partition wall is thin, and the lower portion of the partition wall is thick. At the position (d), the partition wall is thin from the upper portion to the bottom portion. When the blades 14, 14 are retracted to the position (c) in the blade grooves 8, 8, the front end of the blade 14 near the opening 18 contacts the thick section 10, and the curved portion 19 of the blade 14 on the backside contacts the thin section 11.

Figure 3:
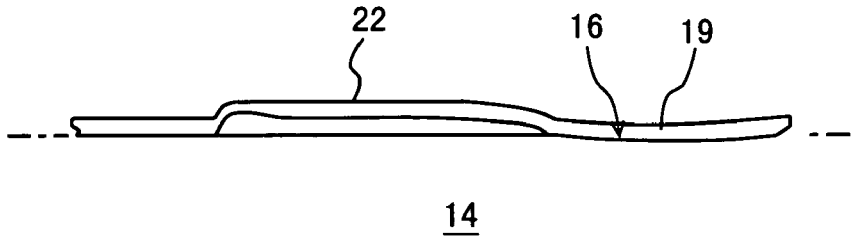
FIG. 3 is a plan view showing main components of the compound needle in FIG. 1.

FIG. 3 shows one single blade 14. FIG. 4 shows a state in which the blades 14, 14 move forward from the blade grooves 8 to a position just before the hook 6. The front ends of the blades 14, 14 are opened outwardly to both of the left and right sides to form the opening 18. The tongues 16 are provided on the front side of the expanded sections 22 in the rear position. The tip of the hook 6 is closed using the tongues 16. Further, the tongues 16 are used to keep the loop for loop transferring or knocking over. The tongue 16 includes the curved portion 19 on the backside of the opening 18. The curved portion 19 is curved inwardly beyond an inner line in the longitudinal direction of the blade 14 indicated by a dotted line in FIG. 3. The pair of the blades 14, 14 elastically contact each other at the curved portions 19, 19. It is not absolutely necessary that the blades 14, 14 contact each other at the curved portions 19, 19. Since the blade 14 contacts each other at the curved portion 19, or the gap between the blade 14 is small at the curved portion 19, the sliding resistance with the partition wall 9 is concentrated at the curved portion 19.

Operation of the embodiment will be described. As shown in FIG. 1, when the blades 14, 14 are retracted into the blade grooves 8, 8, portions of the tongues 16 are hidden in the blade grooves 8, 8, and are not exposed. At this time, the curved portion 19 is positioned at the thin section 11 of the partition wall 9. Thus, the partition wall does not widen the gap between the curved portions 19, 19, and the force applied between the partition wall and the curved portion 19 is small. Further, since the curved portion 19 contacts the thin section 11, the expansion between the blades 14, 14 at the opening 18 is reduced, and the force applied between the curved portions 19, 19 and the left and right outer side walls of the blade grooves 8, 8 is small. Thus, the blades 14, 14 are, so called in the relaxed state, and are accommodated in the blade grooves 8, 8.

As shown in FIG. 4, when the blades 14, 14 move forward to the hook 6 to close the tip of the hook 6 by the tongues 16, 16, a problem may occur depending on the position and orientation of the blades 14, 14 relative to the hook 6. In order to ensure that the blades 14, 14 are suitably positioned or oriented relative to the hook 6, centering of the blades 14, 14 in the blade grooves 8, 8 is necessary when the blades 14, 14 move forward. Further, it is necessary to prevent the change in the orientation of the blades 14, 14 due to the lateral force applied from the knitted loop held by the tongues 16, 16. Thus, the blades 14, 14 move forward from the blade grooves 8, 8 while the blades 14, 14 are centered at the thick section 10.

Next, when the tongues 16 hold the knitted loop by knocking over of the previous loop or the like, the force in the lateral direction (left/right direction) applied from the knitted loop may cause a problem. For example, if the knitted loop is positioned at the right end or the left end of the knitting fabric, or if the knitted loop has been subjected to racking, a tensioning force in the left or right direction is applied to the knitted loop. If the force is received by only one blade 14, the blade 14 may warp, and the two blades are deviated toward one side, i.e., the left or the right side. As a result, it may become impossible to hold the hook 6 in the opening 18. However, in the embodiment, since the blades 14, 14 contact each other at the curved portions 19, 19, the overall rigidity of the blades 14, 14 is twice as large as the rigidity of the single blade. Therefore, it is possible to prevent warpage of the blade by the tension of the thread, and reliably hold the hook 6. Even if there is a small gap initially between the curved portions 19, 19, if one of the blades that firstly receives the tensioning force of the thread is deformed to close the gap, the curved portions 19, 19 contact each other to prevent further deformation. FIG. 5 shows a state in which the blades 14, 14 move forward further until the tongues 16 move to a position beyond the hook 6.

As described above, in the embodiment, the blades 14, 14 are centered at the thick section 10 of the partition wall 9. Further, even if the force from the knitted loop is applied to the blades 14, 14, since the two blades 14, 14 contact each other at the curved portions 19, 19, deformation such as the warpage of the blades is minimized. As a result, it is possible to reliably hold the hook 6 at the opening 18. Thus, the blades 14, 14 do not impinge upon the hook 6, and are not deviated toward one side of the hook 6.

Entry of the dust such as fabric debris into the blade grooves 8 is studied. When the tongues 16, 16 contact a thread or the like, fabric debris or the like may be sandwiched between the tongues, and brought into the blade grooves 8, 8. Thus, the sliding friction between the blades and the blade grooves is increased. Therefore, cleaning operation for removing the fabric debris is required. In the cleaning process, for example, the blades move forward, and a compressed air is blown to the opening 18. In the embodiment, the dust such as the fabric debris is scrubbed down by the thick section 10. At the thin section 11, since the width of the blade grooves 8 is larger than the thickness of the blades, the blades 14, 14 can move forward, and move back until the gap is clogged with the fabric debris. Thus, the cleaning operation of the compound needle does not have to be performed frequently.

In the embodiment, the partition wall includes the thin section 11. Alternatively, instead of providing the thin section 11, a cutout section may be provided. The thin section 11 is provided for reliably guiding the blades.

If the hook 6 is tapered from the base portion to the head portion (front end of the hook 6) such that the thickness of the hook 6 is gradually decreased, by specially designing the shape of the blades 14, 14 at the tongues 16, the sliding resistance between the hook 6 and the tongues 16 is reduced. In the modified embodiment, the shape of the blades 14, 14 is changed, e.g., at the portions of the tongues 16, 16, in particular, the portions of the tongues 16, 16 on the backside of the curved portions 19, 19. In the portions, lower portions of the blades 14, 14 are curved outwardly toward both sides (left and right sides) or twisted outwardly to gradually increase the gap between the blades 14, 14 from the upper portion to the lower portion (bottom portion). As a result, for example, upper portions of the blades 14, 14 contact each other at the curved portions 19, 19, and a gap is formed between the lower portions of the blades 14, 14. The gap matches the tapered portion of the hook 6 to decrease the sliding resistance. The distance between the blades is increased at the lower portion of the curved portion 19 to reduce the sliding resistance with the tapered hook. This effect is also advantageous in the case where no partition wall 9 is provided between the blade grooves.

The invention claimed is:

1. A compound needle comprising: a needle body having a hook and blade grooves with a partition wall between them, the hook being provided at a front end of the needle body; and a slider including a pair of blades, the blades being movable back and forth in the blade grooves, wherein front ends of the two blades are opened toward left and right, and the blades include curved portions curved inwardly on a backside of the front ends of the blades, and wherein the partition wall has a non-uniform thickness in a longitudinal direction including: a relatively thick section on a front end side of the blade grooves; and a relatively thin section or a cutout section on a backside of the thick section.

2. A compound needle according to claim 1, wherein the thickness of the partition wall is relatively thin on the backside.

3. A compound needle according to claim 1, wherein when the two blades move back into the blade grooves, the curved portions contact the thick section or the cutout section of the partition wall.

* * * * *